US009249988B2

(12) United States Patent
Huang et al.

(10) Patent No.: US 9,249,988 B2
(45) Date of Patent: Feb. 2, 2016

(54) DIRECT VENT/POWER VENT WATER HEATER AND METHOD OF TESTING FOR SAFETY THEREOF

(75) Inventors: Chung-Chin Huang, Taichung (TW); Chin-Ying Huang, Taichung (TW); Hsin-Ming Huang, Taichung (TW); Hsing-Hsiung Huang, Taichung (TW); Kuan-Chou Lin, Taichung (TW)

(73) Assignee: Grand Mate Co., Ted., Taichung (TW)

( * ) Notice: Subject to any disclaimer, the term of this patent is extended or adjusted under 35 U.S.C. 154(b) by 1051 days.

(21) Appl. No.: 12/954,444

(22) Filed: Nov. 24, 2010

(65) Prior Publication Data

US 2012/0125268 A1 May 24, 2012

(51) Int. Cl.
*F24H 9/20* (2006.01)
*F23N 5/24* (2006.01)

(52) U.S. Cl.
CPC ..... *F24H 9/2035* (2013.01); *F23N 5/242* (2013.01); *F23N 2031/20* (2013.01); *F23N 2033/08* (2013.01)

(58) Field of Classification Search
None
See application file for complete search history.

(56) References Cited

U.S. PATENT DOCUMENTS 3,630,496 A * 12/1971 Hurst et al. ..... 261/26
4,278,064 A * 7/1981 Regueiro ..... 123/577
4,501,261 A * 2/1985 Tsutsui et al. ..... 122/14.3
4,543,056 A * 9/1985 Sakakibara ..... 431/76
4,706,881 A * 11/1987 Ballard ..... 236/15 BD
4,727,826 A * 3/1988 Draper et al. ..... 122/379
4,792,089 A * 12/1988 Ballard ..... 236/11
4,804,139 A * 2/1989 Bier ..... F01P 7/08 123/41.15
4,854,378 A * 8/1989 Zappia ..... 165/104.19
4,856,982 A * 8/1989 Olson ..... 431/20
4,860,231 A * 8/1989 Ballard et al. ..... 702/47
4,866,633 A * 9/1989 Nakane et al. ..... 700/282
4,872,443 A * 10/1989 Ruark ..... 122/19.2
4,881,948 A * 11/1989 Nakane et al. ..... 48/192
4,892,064 A * 1/1990 Zappia ..... 122/366
4,893,113 A * 1/1990 Park et al. ..... 340/632
4,905,511 A * 3/1990 Reinhold ..... 73/168
4,909,190 A * 3/1990 Finch ..... 122/1 A
4,976,459 A * 12/1990 Lynch ..... 236/11
4,982,721 A * 1/1991 Lynch ..... 126/116 A
5,027,789 A * 7/1991 Lynch ..... 126/116 A
5,090,476 A * 2/1992 Immel ..... 165/122
5,112,217 A * 5/1992 Ripka et al. ..... 431/12
5,126,934 A * 6/1992 MacFadyen ..... 700/11
5,186,386 A * 2/1993 Lynch ..... 236/11
5,199,385 A * 4/1993 Doss ..... 122/14.22
5,255,665 A * 10/1993 Windon ..... 122/18.31
5,418,438 A * 5/1995 Hollenbeck ..... F23N 1/062 165/246

(Continued)

OTHER PUBLICATIONS

USPTO Office Action, dated Dec. 6, 2013, regarding U.S. Appl. No. 13/235,199, 10 pages.

(Continued)

*Primary Examiner* — Gregory Huson
*Assistant Examiner* — Eric Gorman
(74) *Attorney, Agent, or Firm* — Tracy M. Heims; Apex Juris, pllc

(57) ABSTRACT

A water heater includes a combustor, a gas valve, a blower, a detector, and an operating device. The detector senses a speed of a motor of the blower. The operating device is stored with reference speed ranges under various gas supplies to control the gas valve to cut off the gas supply when the detector senses that the speed of the motor of the blower is beyond the reference speed range.

11 Claims, 5 Drawing Sheets

(56) References Cited

U.S. PATENT DOCUMENTS

| | | | | |
|---|---|---|---|---|
| 5,429,059 | A * | 7/1995 | Wagoner et al. | 110/234 |
| 5,458,011 | A * | 10/1995 | Thompson | 73/865.9 |
| 5,526,776 | A * | 6/1996 | Fenn et al. | 122/367.3 |
| 5,601,071 | A * | 2/1997 | Carr et al. | 126/116 A |
| 5,658,140 | A * | 8/1997 | Kondou et al. | 431/90 |
| 5,865,611 | A * | 2/1999 | Maiello | 431/12 |
| 5,899,683 | A * | 5/1999 | Nolte et al. | 431/25 |
| 5,902,098 | A * | 5/1999 | Park | 431/6 |
| 5,984,664 | A * | 11/1999 | Sutton | F23N 1/022 431/12 |
| 6,039,261 | A * | 3/2000 | Pavese | 236/14 |
| 6,273,009 | B1 * | 8/2001 | Magnusson | 110/346 |
| 6,401,669 | B1 * | 6/2002 | Macgowan et al. | 122/448.1 |
| 6,612,267 | B1 * | 9/2003 | West | 122/13.3 |
| 6,694,926 | B2 * | 2/2004 | Baese et al. | 122/14.2 |
| 6,728,600 | B1 * | 4/2004 | Contaldo et al. | 700/274 |
| 6,755,138 | B2 * | 6/2004 | McCarren | 110/162 |
| 7,222,591 | B1 * | 5/2007 | Peart et al. | 122/14.31 |
| 7,647,895 | B2 * | 1/2010 | Donelly et al. | 122/14.21 |
| 7,814,868 | B2 * | 10/2010 | Yin et al. | 122/13.01 |
| 8,011,921 | B2 * | 9/2011 | Kim | 431/12 |
| 8,140,296 | B2 * | 3/2012 | Francino et al. | 702/182 |
| 8,381,689 | B2 * | 2/2013 | Huang et al. | 122/14.22 |
| 8,442,696 | B2 * | 5/2013 | Yokohata et al. | 700/282 |
| 8,522,815 | B2 * | 9/2013 | Honda et al. | 137/459 |
| 8,535,050 | B2 * | 9/2013 | Kuroda | 431/19 |
| 8,558,493 | B2 * | 10/2013 | Woodward | 318/400.3 |
| 8,591,221 | B2 | 11/2013 | Schultz | |
| 2002/0108440 | A1 * | 8/2002 | Colman et al. | 73/304 R |
| 2002/0124992 | A1 * | 9/2002 | Rainer et al. | 165/11.1 |
| 2002/0150850 | A1 * | 10/2002 | Kim et al. | 431/2 |
| 2003/0131804 | A1 * | 7/2003 | Iwama et al. | 122/18.1 |
| 2004/0217182 | A1 * | 11/2004 | St. Jean et al. | 237/2 A |
| 2004/0220777 | A1 * | 11/2004 | St. Jean et al. | 702/185 |
| 2004/0230402 | A1 * | 11/2004 | St. Jean | 702/189 |
| 2005/0159844 | A1 * | 7/2005 | Sigafus et al. | 700/275 |
| 2005/0159845 | A1 * | 7/2005 | Malone et al. | 700/276 |
| 2005/0274328 | A1 * | 12/2005 | Baese et al. | 122/14.1 |
| 2006/0101838 | A1 * | 5/2006 | Ritchey | 62/285 |
| 2007/0099134 | A1 * | 5/2007 | Hamada et al. | 431/12 |
| 2007/0213876 | A1 * | 9/2007 | Warren et al. | 700/276 |
| 2008/0044778 | A1 * | 2/2008 | Kuroda | 431/19 |
| 2008/0078337 | A1 * | 4/2008 | Donnelly et al. | 122/446 |
| 2008/0124667 | A1 | 5/2008 | Schultz | |
| 2008/0138750 | A1 * | 6/2008 | Kim | 431/12 |
| 2008/0223943 | A1 * | 9/2008 | Mulhouse et al. | 236/49.3 |
| 2008/0288198 | A1 * | 11/2008 | Francino et al. | 702/84 |
| 2008/0314062 | A1 * | 12/2008 | Ritchey | 62/291 |
| 2009/0044794 | A1 * | 2/2009 | Hugghins et al. | 126/116 A |
| 2009/0293867 | A1 * | 12/2009 | Chian et al. | 126/99 R |
| 2009/0297997 | A1 * | 12/2009 | Chian et al. | 431/12 |
| 2010/0095905 | A1 * | 4/2010 | Smelcer | 122/14.2 |
| 2010/0112500 | A1 | 5/2010 | Maiello et al. | |
| 2010/0116223 | A1 * | 5/2010 | Tsuji et al. | 122/14.3 |
| 2010/0116225 | A1 * | 5/2010 | Smelcer | 122/17.1 |
| 2010/0195991 | A1 * | 8/2010 | Deivasigamani et al. | 392/308 |
| 2010/0255434 | A1 * | 10/2010 | Kim | 431/12 |
| 2010/0330515 | A1 * | 12/2010 | Ueki et al. | 431/22 |
| 2011/0048342 | A1 * | 3/2011 | Vroom | 122/367.1 |
| 2011/0259446 | A1 * | 10/2011 | Ueki et al. | 137/487.5 |
| 2012/0037096 | A1 * | 2/2012 | Watanabe et al. | 122/14.21 |
| 2012/0115095 | A1 * | 5/2012 | Chian et al. | 431/12 |
| 2012/0154159 | A1 * | 6/2012 | Huang et al. | 340/606 |
| 2013/0071261 | A1 * | 3/2013 | Huang et al. | 417/63 |
| 2013/0145782 | A1 * | 6/2013 | Ritchey | 62/119 |
| 2013/0284116 | A1 * | 10/2013 | Deivasigamani et al. | 122/14.21 |
| 2013/0284117 | A1 * | 10/2013 | Deivasigamani et al. | 122/18.1 |
| 2013/0312671 | A1 * | 11/2013 | Deivasigamani et al. | 122/1 C |
| 2014/0253299 | A1 * | 9/2014 | Huang | G08C 17/02 340/12.5 |
| 2015/0114313 | A1 * | 4/2015 | Huang et al. | 122/14.1 |

OTHER PUBLICATIONS

USPTO Office Action, dated Nov. 21, 2014, regarding U.S. Appl. No. 13/235,199, 14 pages.

USPTO Notice of Allowability, dated Mar. 13, 2015, regarding U.S. Appl. No. 13/235,199, 5 pages.

* cited by examiner

DIRECT VENT/POWER VENT WATER HEATER AND METHOD OF TESTING FOR SAFETY THEREOF

BACKGROUND OF THE INVENTION

1. Field of the Invention

The present invention relates generally to a water heater, and more particularly to a direct vent or power vent water heater and a method of testing for safety thereof.

2. Description of the Related Art

A conventional water heater exhausting gas after burning by convection is very dangerous to be mounted indoors since carbon monoxide generated from the water heater is fatal when the gas is accumulated in the rooms. An improved water heater, direct vent or power vent water heater, was provided, in which a blower is provided to exhaust the gas after burning, including carbon monoxide, out of the rooms and to raise the burning efficiency as well. The blower may provide more gas for burning to generate more heat. Jam or aging of the blower causes a poor ventilation of air in the water heater that burning will generate more carbon monoxide. However, user may think he/she is safe with the direct vent water heater without being aware that it is still dangerous with the direct vent water heater having a jammed or aged blower.

SUMMARY OF THE INVENTION

The primary objective of the present invention is to provide a direct vent water heater and a method of testing for safety of the water heater by testing a speed of the motor of the blower.

According to the objective of the present invention, a water heater includes a combustor, a gas valve, a blower, a detector, and an operating device. The gas valve is provided on a gas pipe to control a gas supply to the combustor. The blower has a motor to provide air to the combustor. The detector senses the speed of the motor of the blower. The operating device has a calculating unit electrically connected to the detector. The operating device is stored with a reference speed range under various gas supplies to control the gas valve to cut off the gas supply when the detector senses the speed of the motor of the blower is beyond the reference speed range.

For a method of testing for safety of a water heater includes sensing the speed of a motor of a blower of the water heater and examining the sensed speed to cut off the gas supply when the sensed speed is beyond a theory speed. The theory speed is a desired speed of the motor, based on an optimal mixing ratio of gas and air under the present gas supply of the gas valve.

DETAILED DESCRIPTION OF THE INVENTION

Figure 1:
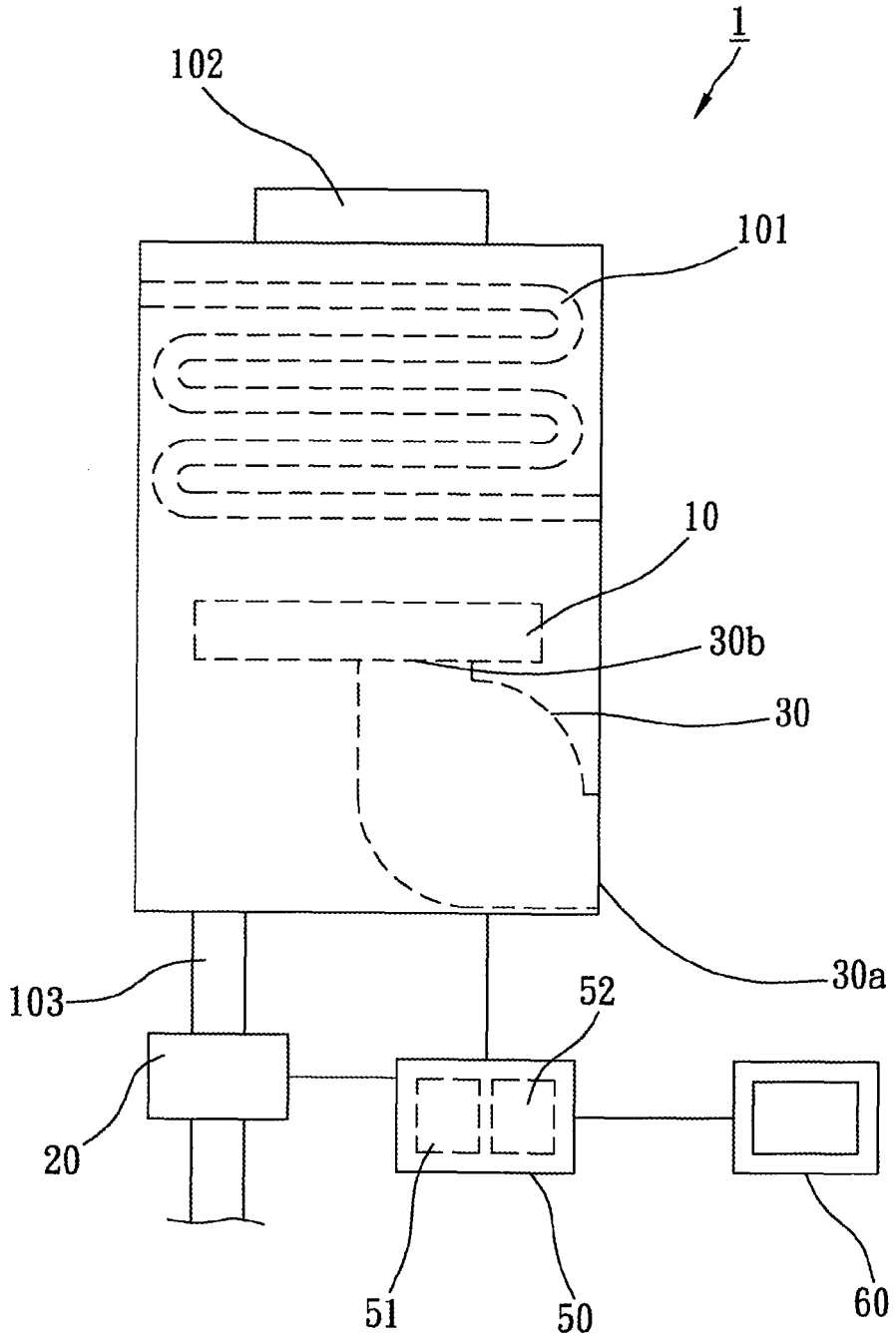
FIG. 1 is a sketch diagram of the water heater of a preferred embodiment of the present invention.
Figure 2:
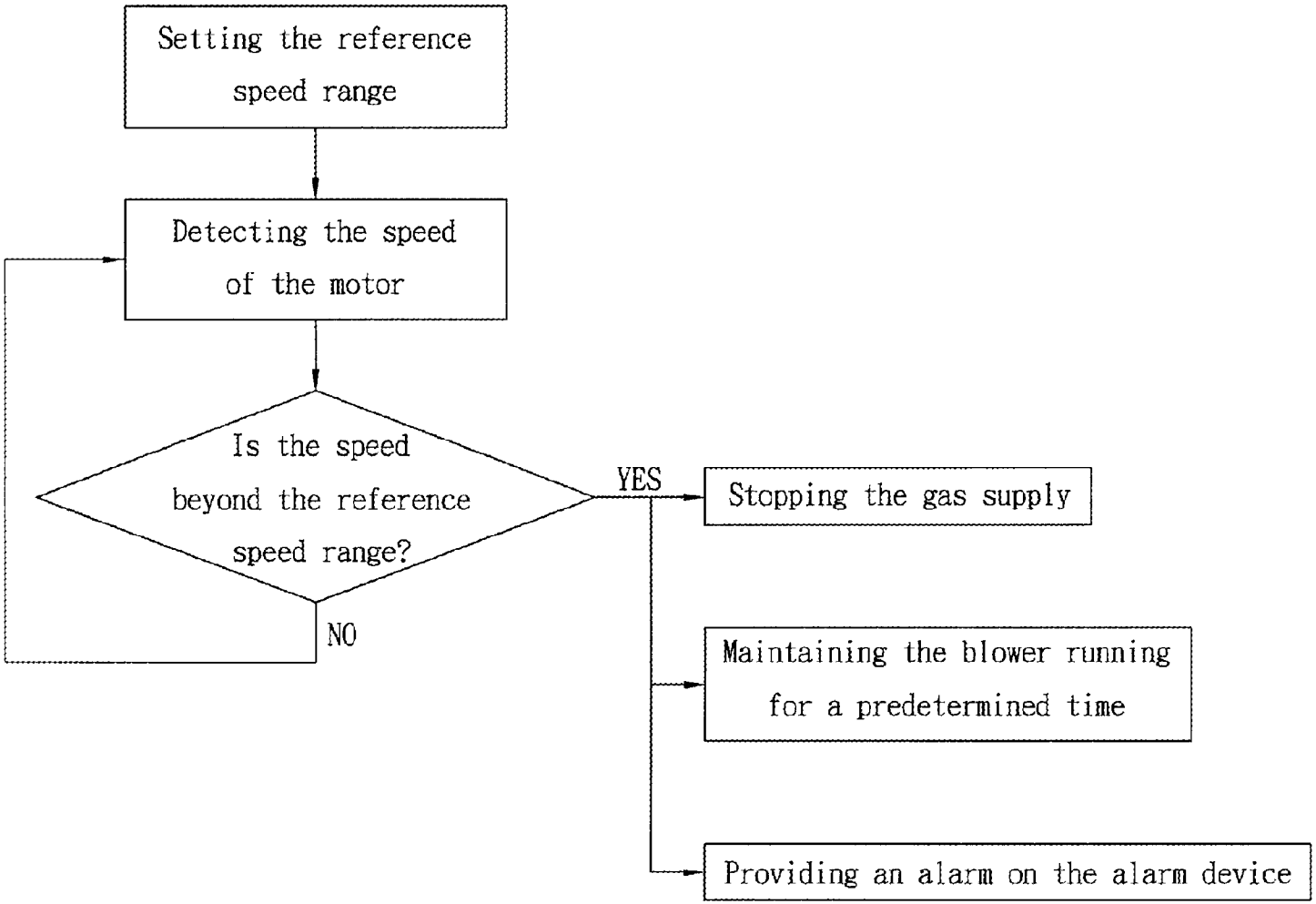
FIG. 2 is a flow chart of the method of testing for the safety of the water heater of the preferred embodiment of the present invention.

FIG. 1 shows the structure of the water heater 1 of the present invention, and FIG. 2 shows the flow chart of the procedures of testing for the safety of the water heater.

The water heater 1 of the preferred embodiment of the present invention includes a combustor 10, a gas valve 20, a blower 30, a detector 40, an operating device 50, and an alarm device 60.

The combustor 10 is under a water pipe 101 to heat up water in the water pipe 101, and after burning gas of the combustor 10 is exhausted through an exhausting pipe 102.

The gas valve 20 is connected to a gas pipe 103 to adjust the gas supply to the combustor 10. The gas valve 20 may be the gas flow rate control valve taught in U.S. patent application 20090206291A1 which the valve is controlled by a current. The gas supply is positively proportional to the current. Any type of valve, such as swivel valve, may be incorporated in the present invention to adjust the gas supply.

The blower 30 is under the combustor 10, in which a DC brushless motor 32 is provided. The blower 30 has an inlet 30*a* and an outlet 30*b* that the motor 32 inhales air via the inlet 30*a* and compresses the air and blows it out to the combustor 10 through the outlet 30*b*. It is easy to understand that the speed of the motor 32 is positively proportional to the air supply, that is, the higher the speed of the motor 32 is, the greater air supply the blower 30 gives. On the contrary, the lower the speed of the motor 32 is, the less air supply the blower 30 gives.

Figure 3:
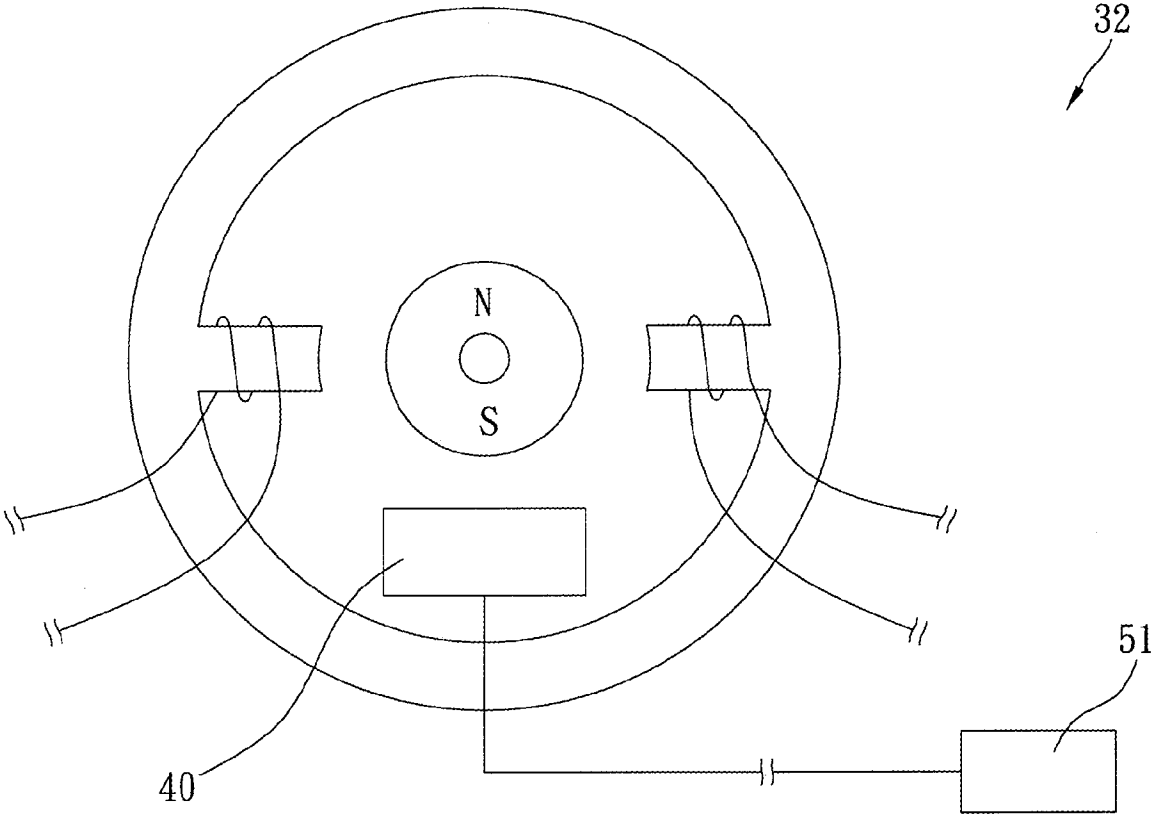
FIG. 3 is a sketch diagram of the motor of the preferred embodiment of the present invention.

As shown in FIG. 3, the detector 40 is a Hall sensor provided in the blower 30 to sense the speed of the motor. Any device that senses the speed of motor may be incorporated in the present invention.

Figure 4:
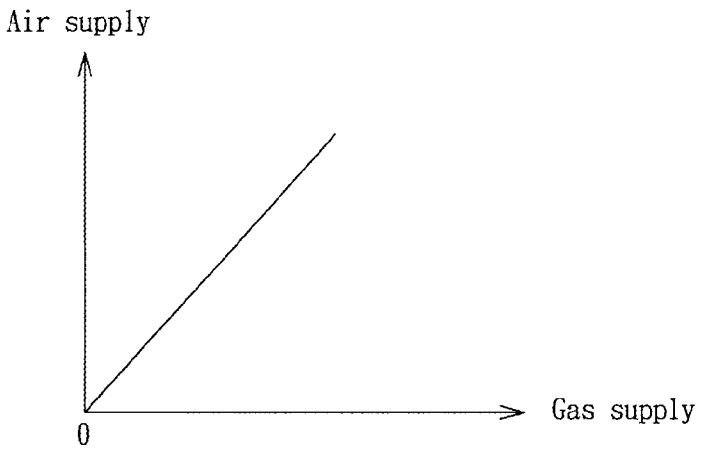
FIG. 4 is a curve diagram of the air supply and gas supply.

The operating device 50 has a calculating unit 51 electrically connected to the detector 40. The calculating unit 51 is stored with theory speeds according to various gas supplies. The theory speeds are based on the following theory. As shown in FIG. 4, it shows that there must be an optimal mixing ratio of air and gas for burning. The gas supply may be known from the gas valve 20. It may calculate the air supply according to the gas supply and the optimal mixing ratio of air to gas, and therefore, it may get the theory speed of the motor 32 according to the air supply. For an aged blower, it usually has a very low speed when one starts the motor 32. We define a low critical speed as a speed which will generate much more carbon monoxide when the motor's speed appears to be lower than this low critical speed. For a jammed blower, including partially blocked or fully blocked, it generates a great pressure in the blower that the motor has to speed up quickly to compensate for it. We define a high critical speed as a speed which is the maximum allowable speed before an abnormal speedup. It appears that it will generate much more carbon monoxide because of jam when the motor's speed is higher than the high critical speed. The motor 32 normally works when its speed is in a reference speed range between the low critical speed and the high critical speed. It is noted that different motors have different low critical speeds and high critical speeds. The low critical speed and the high critical speed are preset in the water heater when the water heater is made.

Figure 5:
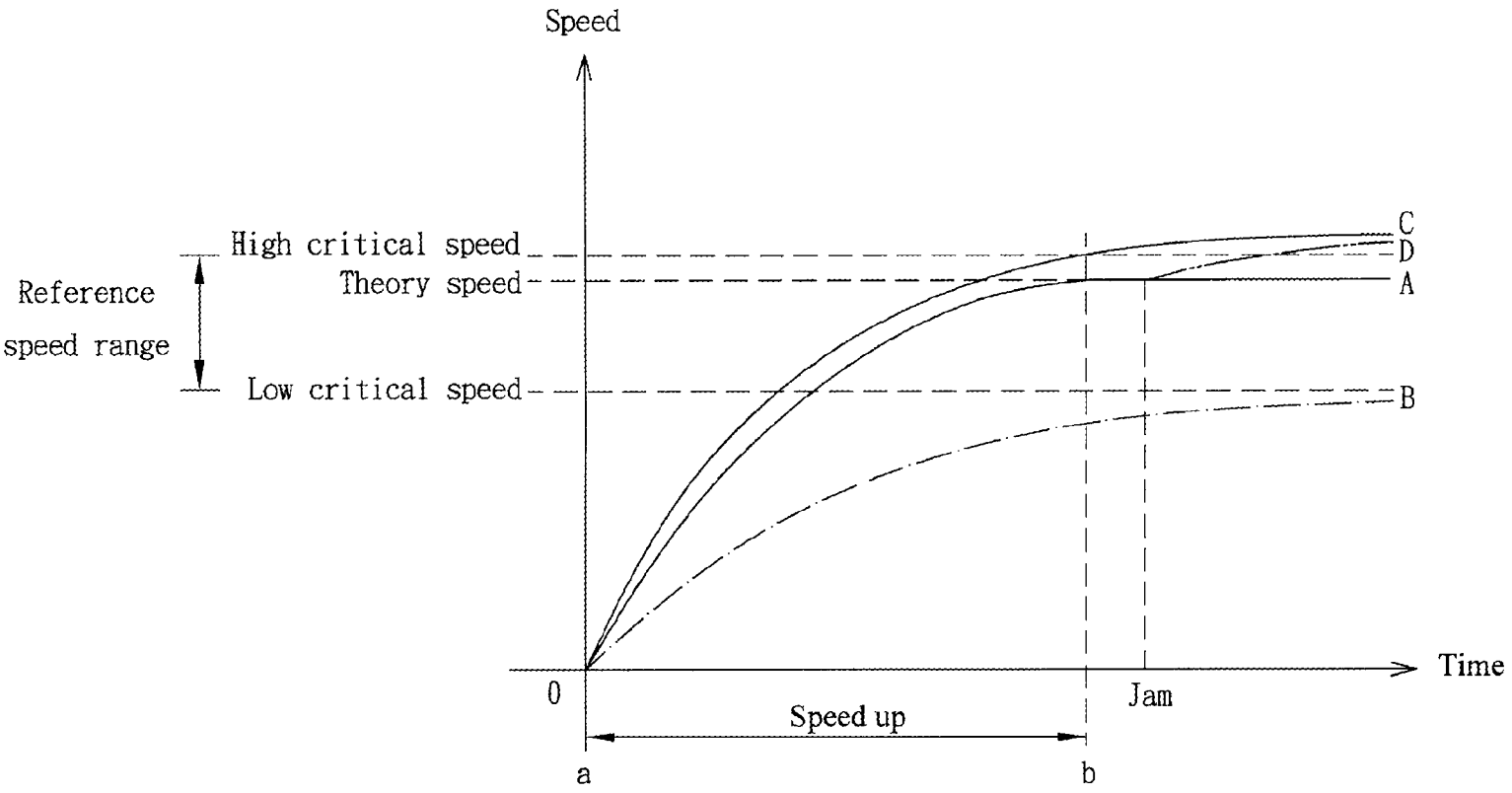
FIG. 5 is a curve diagram of speed of the motor.

As shown in FIG. 5, the curve A shows a relationship between the gas supply and the speed of a functional motor 32. The speed of the motor 32 rises between time a and time b, and keeps a constant speed after time b. The theory speed is the constant speed of the motor 32. In the present invention, the low critical speed is 0.7 times of the theory speed and the high critical speed is 1.04 times of the theory speed. It is noted that the low critical speed and the high critical speed are adjustable according to the type of the motor. The detector 40 starts sensing the speed of the motor 32 after time b, and it indicates that the blower 30 works normally to supply air when the sensed result is in the reference speed range.

On the contrary, the curve B shows relationship between the gas supply and the speed of an aged motor 32. The motor 32 cannot speed up because of power loss that the speed sensed by the detector 40 is lower than the low critical speed. It has poor ventilation in the water heater 1 and generates carbon monoxide because of incomplete burning, which causes fatal danger.

The curve C shows relationship between the gas supply and the speed of a jammed motor 32. The pressure in the blower 30 rises quickly after the blower 30 is started and the speed kept high. The exhausting pipe may be suddenly jammed when the water heater 10 is working. It still makes the pressure in the blower 30 quickly rising and the speed of the motor 32 sharply rising (line D). These two conditions make the speed sensed by the detector 40 higher than the high critical speed and causes incomplete burning to generate carbon monoxide.

The operating device 50 controls the gas valve 20 to cut off the gas supply when it detects that the speed of the motor 32 is beyond the reference speed range. At the same time, the alarm device 60 may give a signal about this situation, like "blower aging" or "jam", to remind the user to repair or to clean the water heater 1.

The operating device 50 further has a delay controller 52 electrically connected to the blower 30 to maintain the motor 32 of the blower running for a predetermined time after the gas valve 20 cuts off the gas supply. It may exhaust residual carbon monoxide out of the water heater 1.

The description above is a few preferred embodiments of the present invention and the equivalence of the present invention is still in the scope of claim construction of the present invention.

What is claimed is:

1. A water heater, comprising:

a combustor;

a gas valve provided on a gas pipe to control a gas supply to the combustor;

a blower having a motor to provide air to the combustor;

a detector directly sensing a speed of the motor of the blower; and an operating device having a calculating unit electrically connected to the detector, wherein the operating device is stored with reference speed ranges of the blower under various gas supplies to control the gas valve;

wherein the reference speed range of the blower is between a low critical speed and a high critical speed of the motor of the blower;

wherein the low critical speed is a minimum allowable speed of the motor for an aged blower, and is greater than zero; and an exhaust pipe to exhaust waste gas of the combustor, and the high critical speed is a maximum allowable speed of the motor before the exhaust pipe is jammed;

wherein the operating device determines whether the blower is working normal or not based on the speed sensed by the detector which is sensed after a predetermined speed up time of the motor, and the operating device determines that the blower works normally when the sensed speed is within the reference range of the blower, and determines to control the gas valve to cut off the gas supply when the sensed speed is outside the reference speed range of the blower.

2. The water heater as defined in claim 1, wherein the low critical speed is 0.7 times of a theory speed, which is a speed of the motor for an optimal mixing ratio of air to gas for burning under the present gas supply of the gas valve.

3. The water heater as defined in claim 1, wherein the high critical speed is 1.04 times of a theory speed, which is a speed of the motor for an optimal mixing ratio of air to gas for burning under the present gas supply of the gas valve.

4. The water heater as defined in claim 1, wherein the motor of the blower is a DC brushless motor and the detector is a Hall sensor.

5. The water heater as defined in claim 1, further comprising a delay controller electrically connected to the blower to maintain the motor of the blower running for a predetermined time after the gas valve cuts off the gas supply.

6. The water heater as defined in claim 1, further comprising an alarm device electrically connected to the operating device to provide a signal when the gas valve cuts off the gas supply.

7. A method of testing for safety of a water heater, the water heater including a blower and a gas supply, the method comprising:

providing an operating device;

detecting a speed of a motor of the blower of the water heater;

examining the speed of the motor by comparing the speed of the motor with a reference speed range of the blower;

wherein the reference speed range of the blower is between a low critical speed and a high critical speed of the motor of the blower;

wherein the low critical speed is a minimum allowable speed of the motor for an aged blower, and is greater than zero; and wherein the water heater further includes an exhaust pipe to exhaust waste gas of the combustor, and the high critical speed is a maximum allowable speed of the motor before the exhaust pipe is jammed; and controlling a gas valve with the operating device by cutting off the gas supply when the speed of the motor is beyond the reference speed range of the blower, and wherein the operating device determines whether the blower is working normal or not based on the speed of the motor of the blower of the water heater directly sensed by a detector which is sensed after a predetermined speed up time of the motor.

8. The method as defined in claim 7, wherein the low critical speed is 0.7 times of a theory speed, which is a speed of the motor for an optimal mixing ratio of air to gas for burning under the present gas supply of the gas valve.

9. The method as defined in claim 7, wherein the high critical speed is 1.04 times of a theory speed, which is a speed of the motor for an optimal mixing ratio of air to gas for burning under the present gas supply of the gas valve.

10. The method as defined in claim 7, further comprising maintaining the motor of the blower running for a predetermined time after the gas flow is cut off.

11. The method as defined in claim 7, further comprising providing an alarm when the speed of the motor is beyond the reference speed range of the blower.

* * * * *